US009283585B2

(12) United States Patent
Isaacs

(10) Patent No.: US 9,283,585 B2
(45) Date of Patent: Mar. 15, 2016

(54) SHEET OF MASKING MEANS

(75) Inventor: Ebrahim Isaacs, Skondal (SE)

(73) Assignee: Smart Masking AB, Enskede (SE)

( * ) Notice: Subject to any disclaimer, the term of this patent is extended or adjusted under 35 U.S.C. 154(b) by 162 days.

(21) Appl. No.: 14/114,358

(22) PCT Filed: Apr. 27, 2012

(86) PCT No.: PCT/SE2012/050446
§ 371 (c)(1),
(2), (4) Date: Dec. 10, 2013

(87) PCT Pub. No.: WO2012/148352
PCT Pub. Date: Nov. 1, 2012

(65) Prior Publication Data

US 2014/0127444 A1 May 8, 2014

(30) Foreign Application Priority Data

Apr. 29, 2011 (SE) ..... 1150375

(51) Int. Cl.
*B05B 15/04* (2006.01)
*B31D 1/00* (2006.01)
*B05D 5/00* (2006.01)

(52) U.S. Cl.
CPC ..... *B05B 15/0456* (2013.01); *B05D 5/00* (2013.01); *B31D 1/0062* (2013.01); *Y10T 428/16* (2015.01)

(58) Field of Classification Search
CPC ..... B05B 15/0456; B31D 1/0062
USPC ..... 428/43, 906; 118/505
See application file for complete search history.

(56) References Cited

U.S. PATENT DOCUMENTS 3,752,304 A 8/1973 Alef
2010/0059162 A1 3/2010 Flanigan

FOREIGN PATENT DOCUMENTS

EP 0705894 A2 4/1996
GB 2415646 A 1/2006

OTHER PUBLICATIONS

International Search Report from corresponding International Application No. PCT/SE2012/050446, mailed on Jun. 13, 2012.

*Primary Examiner* — Alexander Thomas
(74) *Attorney, Agent, or Firm* — Renner, Otto, Boisselle & Sklar, LLP

(57) ABSTRACT

A sheet of masking means (1) which extends in a first direction wherein the sheet (1) has its longest extension, comprising a plurality of flat masking means (2, 2*a*, 2*b*, 2*c*, 2*d*) with an upperside (3*a*) and an underside (3*b*), the masking means (2, 2*a*, 2*b*, 2*c*, 2*d*) comprising a corner portion (4*a*) which comprises a triangle surface which has a first side edge (5*a*, 6*a*, 7*a*, 8*a*) and a second side edge (5*b*, 6*b*, 7*b*, 8*b*) further comprising an angle μ which is defined between the first and second side edge where a first masking means (2*a*) has the apex of the angle μ directed perpendicular to the first direction a second masking means (2*b*) has the apex of the angle μ directed perpendicular to the first direction in an opposite direction in relation to the apex μ of the first masking means (2*a*) where the first side edge (5*a*) of the corner portion (4*a*) of the first masking means (2*a*) runs parallel to the first side edge (6*a*) of the corner portion (4*a*) of the second masking means (2*b*) a third masking means (2*c*) which has the apex of the angle μ directed in the same direction as the angle μ of the first masking means (2*a*), where the second side edge (7*b*) of the corner portion (4*a*) of the third masking means (2*c*) runs parallel to the second side edge (6*b*) of the corner portion (4*a*) of the second masking means (2*b*) where the first (2*a*) and third masking means are held together by a material bridge (9, 9*a*).

12 Claims, 3 Drawing Sheets

SHEET OF MASKING MEANS

TECHNICAL FIELD

The present invention relates generally to a sheet of masking means comprising a plurality of masking means.

BACKGROUND ART

It is known to use tape for masking of corners in connection to painting work, for instance for painting of walls, roofs, borders, door cases, window seats etc., with the purpose to prevent paint from coming into contact with surfaces which are not intended to be painted. In the preparation work before painting, it is common that corners, often having an angle of 90°, shall be masked, for instance the masking of a floor surface in a corner of the wall. A problem facing a painter aiming to mask a corner with masking tape is to successfully cover the entire surface to be masked since the masking tape in most cases are torn off and gets a non-perpendicular tear edge. A sloping or inclined tear edge can lead to that surfaces are exposed and get exposed for splash of paint which can lead to costly renovation work and delays in the work. At the same time, it can be a disadvantage or impossible to place masking tape pieces that are slightly too long in a corner as it is true that it covers for instance the entire floor surface corner, but, in such case, unfortunately also parts of the wall that is intended to be painted.

A number of attempts have been made to overcome the problem above. In the patent application US2010/0059162 A1 an embodiment is described comprising perpendicular or right-angled tape pieces having perforation axis between them which by an adhesive surface abut a backing paper which is rolled-up in a storage condition. In another embodiment the tape pieces have the shape of triangles which are arranged in a grid-pattern, have both adhesive and non-adhesive zones on the dorsal side and which are mounted adjacent on a backing paper which is rolled-up in a storage condition. The disadvantage of this solution is partly that the perforation creates a certain risk that the tear edge is not getting right-angled and thus functionable for the purpose of the first embodiment, partly that the arrangement of triangles according to a grid-pattern corresponds to an aggravated manufacturing process where only parts of the undersides or dorsal sides of the triangles shall be applied with adhesive. Further, a backing paper is used that increases the cost of manufacturing and the waste during use.

U.S. Pat. No. 3,752,304 concerns a masking aid means for masking of rectangular surfaces that enables painting of the peripheral edges thereof. The means comprises rectangles which are perforated and separable along a diagonal and thus form the hypotenuse of two triangular means. The rectangle can be used in its entirety or as individual rectangles and be adapted for the rectangular surface to be masked through making the hypotenuses overlap each other. On the back of each of the triangles there is adhesive comprised by removable adhesive strips. The masking aid means according to this description is intended for covering entire larger surfaces such as windows of different size and does not indicate how a large number of masking means can be manufactured and stored in a cost effective manner.

SUMMARY OF INVENTION

An object of the present invention is to improve sheet of masking means comprising plurality of masking means by reducing the cost for manufacturing of the same.

Another object is to increase the number masking means in rolls of the sheet of masking means in a storage condition per unit volume of these rolls and thereby reduce a negative environmental impact by that fewer transports will be required for transporting these at all stages from manufacturing to end-user. It is an adjacent object to reduce the inconvenience in connection to that the masking means run out for a user that consumes large amounts of masking means.

A further objective is to reduce the waste in connection to usage of the masking means.

At least one of the above objects are achieved by the following:

According to one embodiment a sheet of masking means is shown which extends in a first direction wherein the sheet has its longest extension, comprising a plurality of flat masking means with an upperside and an underside, the masking means comprising a corner portion which comprises a triangle surface which has a first side edge and a second side edge further comprising an angle μ which is defined between the first and second side edge where a first masking means has the apex of the angle μ directed perpendicular to the first direction a second masking means has the apex of the angle μ directed perpendicular to the first direction in an opposite direction in relation to the apex μ of the first masking means where the first side edge of the corner portion of the first masking means runs parallel to the first side edge of the corner portion of the second masking means a third masking means which has the apex of the angle μ directed in the same direction as the angle μ of the first masking means, where the second side edge of the corner portion of the third masking means runs parallel to the second side edge of the corner portion of the second masking means where the first and third masking means are held together by a material bridge.

According to a further embodiment a sheet of masking means is shown, wherein the corner portion comprises a isosceles triangle surface where the first side edge and second side edge are of the same length.

According to another embodiment a sheet of masking means is shown, wherein an adhesive is arranged underneath at least a portion of the corner portion on the underside of the masking means.

According to a further embodiment a sheet of masking means is shown, wherein the adhesive is arranged in at least an adhesive portion underneath the corner portions wherein the adhesive portion runs essentially along the extension direction of the sheet of masking means in the first direction.

According to another embodiment a sheet of masking means is shown, comprising a fourth masking means with a corner portion, wherein the fourth masking means has the apex of the angle μ directed in the same direction as the angle μ of the second masking means, wherein the first side edge of corner portion of the fourth masking means runs parallel to the first side edge of the corner portion of the third masking means, where the second and fourth masking means are held together by a material bridge.

According to a further embodiment a sheet of masking means is shown, comprising masking means which have a gripping portion which has at least one side edge that is separate from the first side edge and second side edge of the masking means, where the gripping portion of the first masking means is adjacent to the gripping portion of the third masking means at this side edge, and where the material bridge between the first masking means and the third masking means is arranged in this side edge.

According to a further embodiment a sheet of masking means is shown, comprising an arbitrary number of the masking means.

According to a further embodiment a sheet of masking means is shown, where the arbitrary number of multiples of the masking means are held together by material bridges.

According to a further embodiment a sheet of masking means is shown, wherein the sheet of masking means is arranged in a roll wound in several turns, such that the underside of the masking means in the sheet of masking means wound in a later turn abuts the upperside of a masking means in the sheet of masking means wound in a previous turn.

According to a further embodiment a sheet of masking means is shown, wherein the angle μ is 90°.

According to a further embodiment a sheet of masking means is shown, wherein the gripping portion has three side edges and essentially is shaped as a rectangle.

According to a further embodiment a sheet of masking means is shown, wherein at least a portion of the gripping portion is shaped as an arc of a circle.

According to a further embodiment a method of manufacturing a sheet of masking means is shown, which extends in a first direction wherein the sheet has its longest extension, comprising a plurality of masking means comprising corner portions having an upperside and an underside, further comprising the steps:

moving a sheet whereby it passes a plurality of rollers whereby at least one of said rollers is a punching tool punching of the sheet into a plurality of masking means whereby at least a first masking means and a third masking means are held together by that the punching tool leaves a small distance between these masking means unpunched.

According to a further embodiment a method is shown, which further comprises the step:

arranging adhesive on at least a portion of the underside of the corner portions along an adhesive portion, wherein the adhesive portion runs essentially along the extension direction of the masking means in the first direction.

According to a further embodiment a method is shown, comprising an adhesive consisting of for instance natural rubber, synthetic rubber, pure acrylic, modified acrylic or silicon adhesives.

BRIEF DESCRIPTION OF DRAWINGS

The invention is now described, by way of example, with reference to the accompanying drawings, in which.

DESCRIPTION OF EMBODIMENTS

Figure 1A:
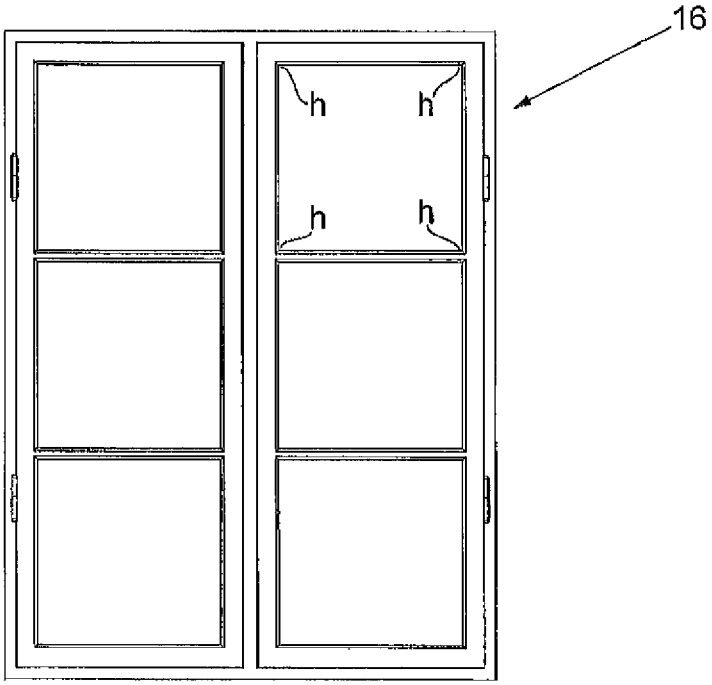
FIG. 1*a* shows an example where masking means according to the invention is useful.

In the following, a detailed description of the embodiments will be given:

FIG. 1*a* shows an example of a field of use for masking means according to the invention. A single glass window 16, according to the example, that is to be painted and therefore be masked, requires 48 masking means for masking of the windows alone. A limited number of these corners h are given in FIG. 1*a*. A corresponding double glass window for the window type according to FIG. 1 thus has twice as many corners as this, i.e. 96 that need to be masked. It thus follows from the figure that the need for masking means is large, so there is also need for cost effectively manufactured masking means that do not generate unnecessary amount of waste during use.

Figure 1B:
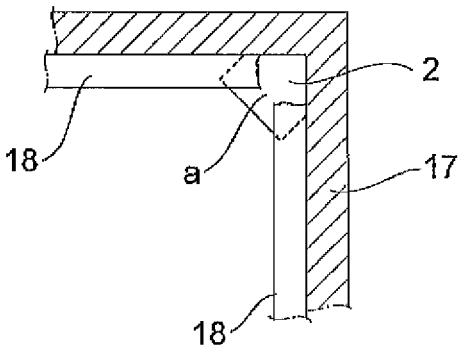
FIG. 1*b* shows a masking means applied for masking of a corner together with known masking tape.

FIG. 1*b* shows another example of field of use for a masking means according to the invention, wherein the masking means 2 has been applied in a corner h, e.g. on the floor close to the corner of a wall. FIG. 1*b* shows the actual corner portion of a cross-section of a wall 17. The same figure furthermore shows how the masking means 2 according to the invention is used together with masking tape 18 of known type that is applied on top of the masking means 2.

Figure 2A:
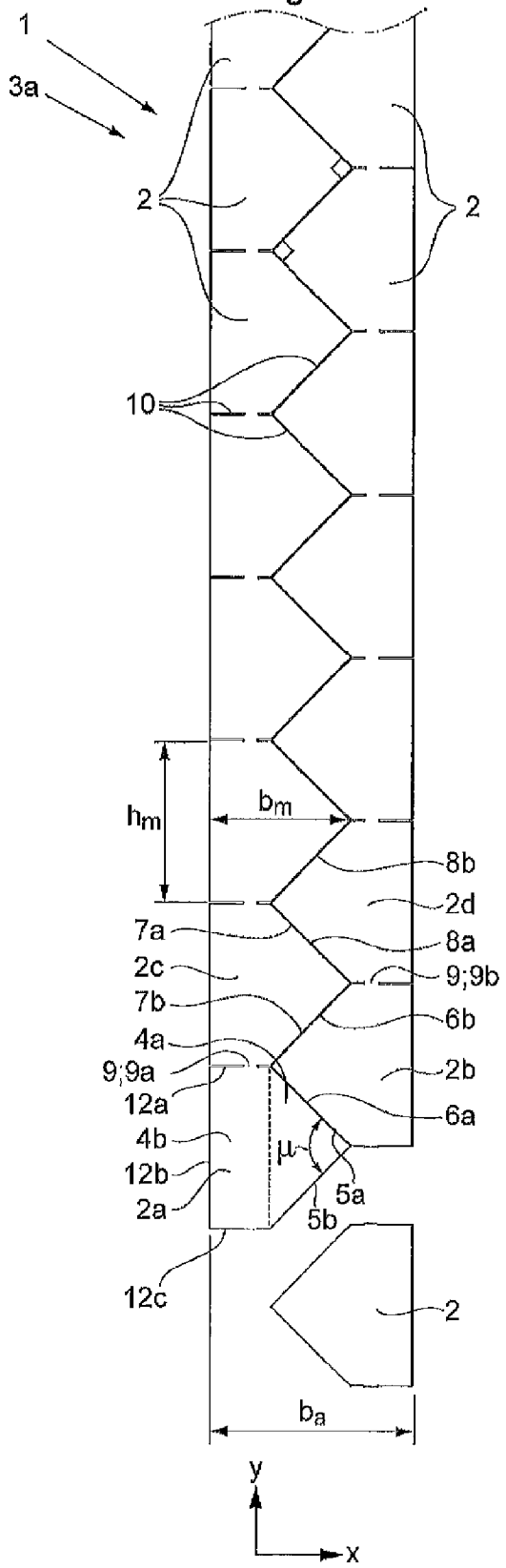
FIG. 2*a* shows the upperside of a sheet of masking means comprising a plurality of flat masking means.

FIG. 2*a*, shows the upperside 3 of a masking means 1 comprising a plurality of flat masking means 2 according to a first embodiment, comprising at least a first flat masking means 2*a*, a second flat masking means 2*b*, and a third flat masking means 2*c*. The sheet of masking means 1 has an elongated shape with an essentially constant width $b_a$ and extends in a first direction y wherein the sheet has its longest extension and in a second direction x which defines the width direction of the sheet of masking means. The sheet of masking means 1 has an upperside 3*a* and an underside 3*b*. In one embodiment the width $b_a$ of the sheet of masking means is 60 mm. The flat masking means 2 has an upperside 3*a* and an underside 3*b* that corresponds to the upper- and underside of the sheet of masking means 1 described above, where at least a sub portion of the underside is coated with an adhesive of some kind, for instance natural rubber, synthetic rubber, pure acrylic, modified acrylic, silicon adhesives, or other adhesives.

The flat masking means comprises a corner portion 4*a* and a gripping portion 4*b*. An imaginary, dashed line according to FIG. 2*a* in the first masking means 2*a* divides the masking means in these portions. The corner portions 4*a* comprises an isosceles triangle portion having a first side edge 5*a* and a second side edge 5*b*, these side edges are accordingly of an identical length. An angle μ is defined between the first and second side edge and according to the embodiment in FIG. 1 it is 90°. Such angle μ=90° and a height $h_m$ of a flat masking means 2 in the first direction which is 50 mm gives using simple trigonometric calculations a total width $b_m$ of the masking means of 42.5 mm in a second direction x perpendicularly defined in relation to the first direction y.

A first masking means 2*a* is arranged in the sheet of masking means 1 in such way that that the tip or apex corresponding to angle μ is directed in a second direction x, perpendicular to the first direction y.

A second masking means 2*b* is arranged in the sheet of masking means 1 in such way that that the apex corresponding to angle μ is directed in a second direction x, perpendicular to the first direction y, but opposite the second direction x, i.e. in a direction −x. In the sheet of masking means 1, the first masking means 2*a* is arranged in relation to the second masking means 2*b* so that the first side edge 5*a* of the first masking means 2*a* runs parallel to and is adjacent to the first side edge 6*a* of the corner portion 4*a* of the second masking means 2*b*.

A third masking means 2*c* is arranged in the sheet of masking means 1 in an identical way in relation to the first masking means 2*a*, i.e. has the apex of the angle μ directed in the same second direction x as the angle μ of the first masking means 2*a*. The second side edge 7*b* of the third masking means 2*c* thereby runs parallel to and is adjacent to the second side edge 6*b* of the corner portion 4*a* of the second masking means 2*b*.

A fourth masking means 2*d* is arranged in the sheet of masking means 1 in an identical manner in relation to the second masking means 2*b*, i.e. the fourth masking means 2*d* has the apex of the angle μ directed in the same direction as the angle μ of the second masking means 2*b*. The first side edge 8*a* of the fourth masking means 2*d* therefore runs parallel to and is adjacent to the first side edge 7*a* of the third masking means 2*c*.

The individual masking means 2 together forms a sheet of masking means 1 by being connected via material bridges 9. The first and third masking means (2*a*, 2*b*) are held together by a material bridge 9*a* where the first and third masking means (2*a*, 2*b*) are adjacent to each other. Analogously, the second and fourth masking means (2*c*, 2*d*) are held together by a material bridge 9*b* were the second and fourth masking means (2*c*, 2*d*) are adjacent to each other. The sheet of masking means 1 is further formed by the connection of multiples of masking means 2*a*-2*d*, which at connection increasingly extends in the first direction y. These multiples of masking means 2*a*-2*d* are held together by material bridges 9. Accordingly, the masking means according to this embodiment are arranged stepwise overlapped with a displacement in the first direction y of a half length of the masking means. In another embodiment (not shown), where μ≠90° and the side edges thus are of different length, this displacement in the y-direction may be less than a half length of a masking means.

The portions 10, the material bridges 9 excepted, where the masking means 2 are adjacent to each other are punched by that a large sheet during manufacturing of the sheet of masking means 1 pass a number of rollers (not shown) of which at least one of these rollers is a punching tool that punches the sheet in masking means 2 according to the above. By that the punching tool is adapted to leave a small distance 9 unpunched the individual masking means are held together. It is thus this unpunched distance 9 which forms the material bridge 9 described according to the above.

Figure 2B:
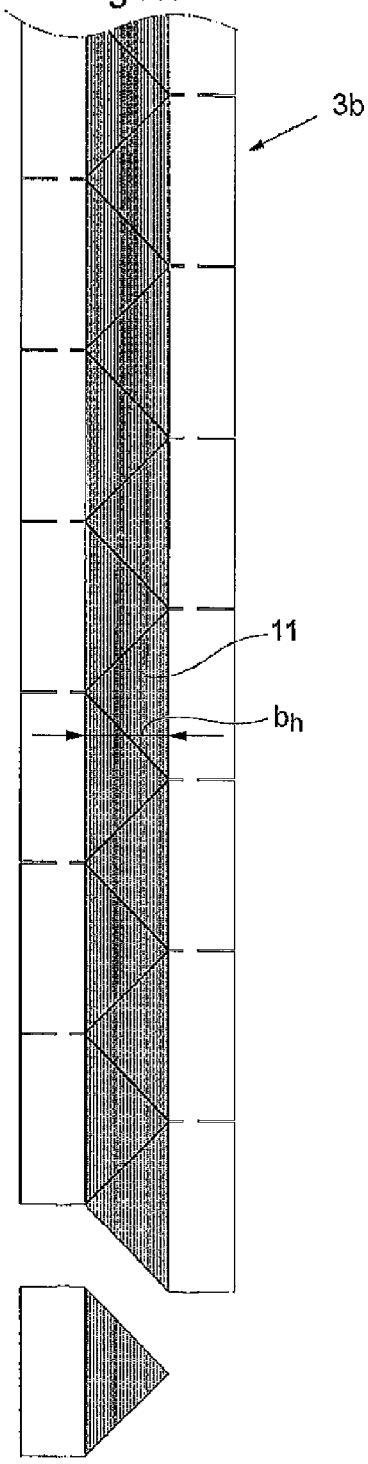
FIG. 2*b* shows the underside of a sheet of masking means comprising a plurality of flat masking means.
Figure 3:
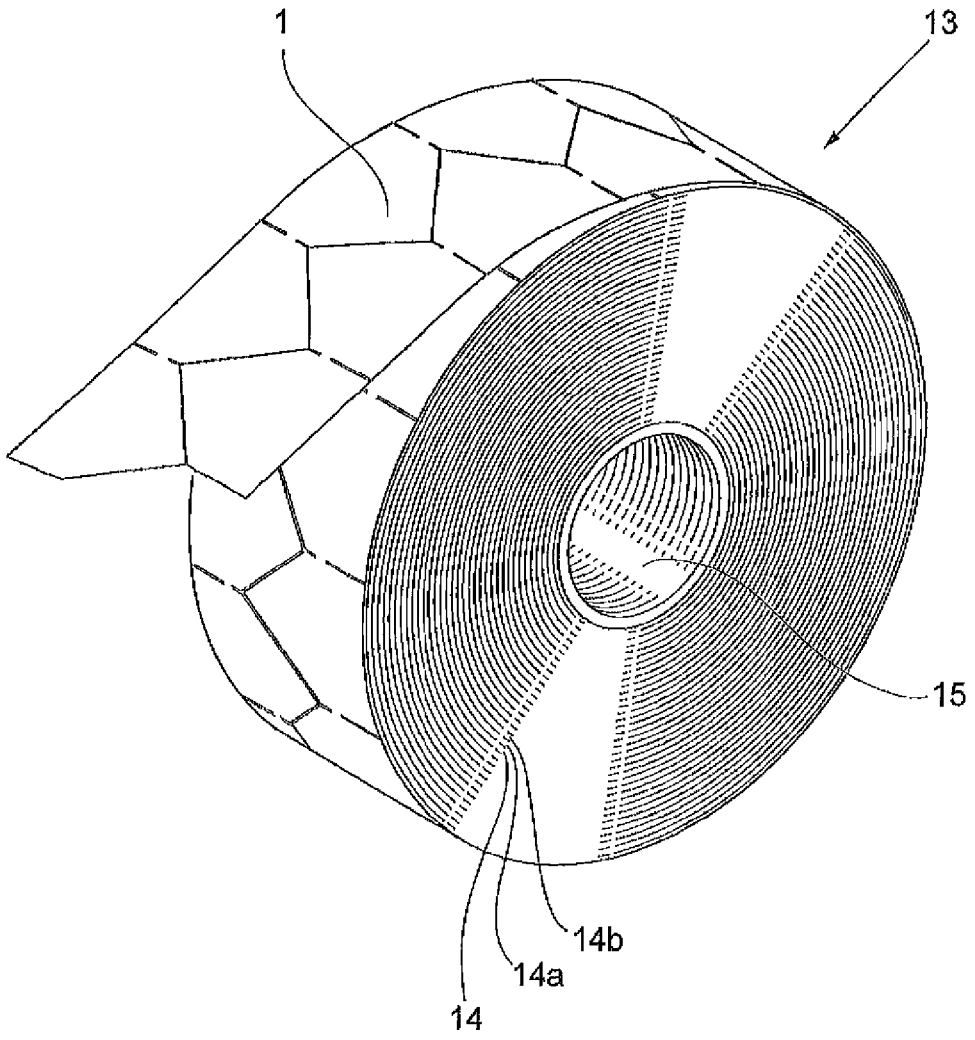
FIG. 3 shows a sheet of masking means comprising a plurality of flat masking means wound in a roll in a storage condition.

FIG. 2*b* shows the adhesive side of the same sheet of masking means as shown in FIG. 2*a*. This side is coated with an adhesive 11 of some kind, which can be for instance natural rubber, synthetic rubber, pure acrylic, modified acrylic, silicon adhesives, or other adhesives, and which is shown by the dashed portion 11, so that the masking means may be applied and removably attach to the corners to be masked in a simple way. The adhesive portion 11 on sheet of masking means has extension directions that essentially correspond to the sheet of masking means 2, i.e. it extends essentially in a first direction y and has an essentially constant width $b_h$ in an x-direction. The adhesive 11 is applied on the underside 3*b* of the sheet of masking means 1 in such way that it covers all the entire corner portions 4*a* of the individual masking means 2. According to the above given geometric dimensions for the width $b_a$ of the sheet of masking means 1 (60 mm) and the individual masking means 2 (50 mm), and the angle μ (90°) the width of the applied adhesive is obtained through simple trigonometric calculations to 25 mm. The adhesive 11 can be applied to the sheet of masking means before of after the punching of the sheet. It should also be understood that more than one adhesive portions can be applied parallely along the underside 3*b* in another, not shown, embodiment.

The masking means 2 comprises a gripping portion 4*b* that has at least one side edge 12*a* which is separate from the first (5*a*, 6*a*, 7*a*, 8*a*) and second (5*b*, 6*b*, 7*b*, 8*b*) side edge of the corner portion 4*a* of the masking means 2 and which gripping portion 4*b* essentially lacks adhesive 11 on its underside 3*b* as is made clear from FIG. 2*b*. As is further made clear from the embodiment according to FIG. 2*b*, the material bridges 9 that connects, i.e. holds the masking means together are arranged in this portion. The gripping portions 4*b* facilitates removal of the masking means 2 from the sheet of masking means 1 but also applying and removing the masking means 2 or applied masking tape 18 of normal type in corner portions h during use, by that adhesives 11 essentially is lacking in this portion which in turn prevents that the masking means 2 sticks to unwanted places or on the fingers of a user. The gripping portions 4*b* are in one embodiment according to FIG. 2*b* shaped as a rectangle having 3 side edges, 12*a*, 12*b*, 12*c*. In another embodiment (not shown) the gripping portion only has one side edge, shaped has an arc of a circle, wherein the width of the sheet of masking means 1 thus gets a varying wavelike width.

FIG. 4*a* shows the sheet of masking means 1 arranged in a roll 13 wound in several turns 14 around for instance a hollow plastic cylinder 15, so that the underside 3*b* of the masking means 2 in the sheet of masking means 1 wound in a later turn 14*a* abuts the upperside 3*a* of a masking means 2 in the sheet of masking means 1 wound in an earlier turn 14*b*. The underside 3*b* of a masking means 2 wound in a later turn 14*a* thus abut the upperside 3*a* of a masking means 2 wound in an earlier turn 14*a* in a direct manner. This should be understood as when the masking means are attached on a protective paper, for instance of glossy stripe type, in a storage condition such as in a roll 13, there is no protective paper between the different layers of masking means 2 or sheet of masking means 1. Thanks to the connection between individual masking means 2 by the aid of material bridges 9 the winding of the sheet of masking means around itself is enabled without the need for such protective paper. From this it follows that both the volume of the roll the sheet of masking means 1 and the waste that is created during use of the masking means can be minimized.

The sheet of masking means 1 arranged in a roll 13 can preferably be arranged in some kind of container, preferably of plastic material (not shown). During use of the masking means 2, a part of the sheet of masking means 1 is allowed to stand out from the container, at least one masking means, which is removed from the sheet of masking means through separating the masking means at the material bridges 9, which thus are torn off when a new masking means shall be applied to mask a corner.

The sheet of masking means as described above can consist of for instance PVC film, PE film, paper, either smooth or with a varying degree of creping, or different woven material.

The invention claimed is:

1. A sheet of masking means which extends in a first direction wherein the sheet has its longest extension, comprising a plurality of individual flat masking means with an upperside and an underside, the masking means comprising a corner portion which comprises a triangle surface which has a first side edge) and a second side edge further comprising an angle μ which is defined between the first and second side edge, wherein a first masking means has the apex of the angle μ directed perpendicular to the first direction, a second masking means has the apex of the angle μ directed perpendicular to the first direction in an opposite direction in relation to the apex μ of the first masking means, where the first side edge of the corner portion of the first masking means runs parallel to and is adjacent to the first side edge of the corner portion of the second masking means, a third masking means which has the apex of the angle μ directed in the same direction as the angle μ of the first masking means, where the second side edge of the corner portion of the third masking means runs parallel to and is adjacent to the second side edge of the corner portion of the second masking means where the first and third masking means are held together by a material bridge.

2. A sheet of masking means according to claim 1, wherein the corner portion comprises a isosceles triangle surface where the first side edge and second side edge are of the same length.

3. A sheet of masking means according to claim 1, wherein an adhesive is arranged underneath at least a portion of the corner portion on the underside of the masking means.

4. A sheet of masking means according to claim 3, wherein the adhesive is arranged in at least an adhesive portion underneath the corner portions wherein the adhesive portion runs essentially along the extension direction of the sheet of masking means in the first direction.

5. A sheet of masking means according to claim 1, comprising a fourth masking means with a corner portion, wherein the fourth masking means has the apex of the angle μ directed in the same direction as the angle μ of the second masking means, wherein the first side edge of corner portion of the fourth masking means runs parallel to and is adjacent to the first side edge of the corner portion of the third masking means, where the second and fourth masking means are held together by a material bridge.

6. A sheet of masking means according to claim 1, comprising masking means which have a gripping portion which has at least one side edge that is separate from the first side edge and second side edge of the masking means, where the gripping portion of the first masking means is adjacent to the gripping portion of the third masking means at this side edge, and where the material bridge between the first masking means and the third masking means is arranged in this side edge.

7. A sheet of masking means according to claim 6, wherein the gripping portion has three side edges and essentially is shaped as a rectangle.

8. A sheet of masking means according to claim 6, wherein at least a portion of the gripping portion is shaped as an arc of a circle.

9. A sheet of masking means according to claim 1, comprising an arbitrary number of multiples of the masking means.

10. A sheet of masking means according to claim 7, where the arbitrary number of multiples of the masking means are held together by material bridges.

11. A sheet of masking means according to claim 1, wherein the sheet of masking means is arranged in a roll wound in several turns, such that the underside of the masking means in the sheet of masking means wound in a later turn abuts the upperside of a masking means in the sheet of masking means wound in a previous turn.

12. A sheet of masking means according to claim 1, wherein the angle μ is 90°.

* * * * *